US006591944B2

(12) United States Patent
St. Pierre et al.

(10) Patent No.: US 6,591,944 B2
(45) Date of Patent: Jul. 15, 2003

(54) METHOD AND APPARATUS FOR ADJUSTING STEERING ANGLE FOR ELEVATOR SHEAVE

(75) Inventors: Bruce St. Pierre, Bristol, CT (US); Bruce P. Swaybill, Farmington, CT (US); Boris G. Traktovenko, Avon, CT (US); Mark F. Orelup, Torrington, CT (US)

(73) Assignee: Otis Elevator Company, Farmington, CT (US)

( * ) Notice: Subject to any disclaimer, the term of this patent is extended or adjusted under 35 U.S.C. 154(b) by 19 days.

(21) Appl. No.: 09/734,991

(22) Filed: Dec. 12, 2000

(65) Prior Publication Data

US 2002/0074191 A1 Jun. 20, 2002

(51) Int. Cl.[7] ..... B66B 11/08
(52) U.S. Cl. ..... 187/254; 187/250; 187/261
(58) Field of Search ..... 187/250, 254, 187/261

(56) References Cited

U.S. PATENT DOCUMENTS

| | | | | |
|---|---|---|---|---|
| 5,358,074 A | * | 10/1994 | Ellsworth | 187/250 X |
| 5,427,581 A | | 6/1995 | McGrath et al. | |
| 5,676,613 A | | 10/1997 | Valcourt et al. | |

FOREIGN PATENT DOCUMENTS

| | | | | |
|---|---|---|---|---|
| JP | 6255937 | * | 9/1994 | |
| WO | 87/02344 | * | 4/1987 | 187/254 |

* cited by examiner

*Primary Examiner*—Steven A. Bratlie
(74) *Attorney, Agent, or Firm*—Wall Marjama & Bilinski LLP

(57) ABSTRACT

A steering angle of an elevator sheave on a shaft is adjusted at installation and subsequently during maintenance by one of several embodiments. In one embodiment, a bolt with a jam nut is adjusted to position the shaft precisely. In another embodiment, a tee bracket is anchored to a hoistway wall, and a jack bolt with shims is used to adjust the vertical placement of the long beams that support the elevator car frame and therefore the shaft.

10 Claims, 4 Drawing Sheets

METHOD AND APPARATUS FOR ADJUSTING STEERING ANGLE FOR ELEVATOR SHEAVE

FIELD OF THE INVENTION

This invention pertains to the field of elevators, and in particular, to adjusting the steering angle of an elevator sheave during or after installation.

BACKGROUND OF THE INVENTION

When flat ropes or belts pass over a sheave or shaft, they tend to move ("track") across the sheave or shaft under certain conditions: (1) if the belt is not almost perfectly perpendicular to the shaft, or (2) if the belt has non-uniform properties across its cross-section. For example, the sanding belt of a belt sander moves across the shaft during use, necessitating an adjustment of the shaft to ensure perpendicularity between the sanding belt and the shaft. Another example is a VCR, which has a tracking control for the same purpose. If the lateral movement of the belt across the shaft is too great, the belt can track off the shaft and become damaged, tangled, or cut in two.

With the advent of belt-powered machinery during the early industrial age, it was discovered that making the belt with a slightly curved cross-section and imparting a slight curve (crown) to the shaft reduced tracking and limited horizontal belt movement to a small area. Thus, a region of stability exists as long as the angle between the belt and the shaft are close to 90 degrees, even if exact perpendicularity is not maintained.

In the case of an elevator using coated steel belts (CSB) instead of wire ropes, the shaft must be installed within the region of stability, and must be capable of being adjusted as needed throughout the life of the elevator.

SUMMARY OF THE INVENTION

Briefly stated, a steering angle of an elevator sheave on a shaft is adjusted at installation and subsequently during maintenance by one of several embodiments. In one embodiment, a bolt with a jam nut is adjusted to position the shaft precisely. In another embodiment, a tee bracket is anchored to a hoistway wall, and a jack bolt with shims is used to adjust the vertical placement of the long beams that support the elevator car frame and therefore the shaft.

According to an embodiment of the invention, an apparatus for adjusting a steering angle of an elevator sheave on a shaft includes retaining means for retaining the shaft in an elevator car frame; vertical positioning means for adjusting a vertical position of the shaft; and horizontal positioning means for adjusting a horizontal position of the shaft; whereby an axial direction of the shaft is adjusted to be substantially perpendicular to a gravitational force acting on the elevator car frame.

According to an embodiment of the invention, an apparatus for adjusting a steering angle of an elevator sheave on a shaft includes a retainer retaining the shaft in a first frame; a flat rope reeved over the sheave, the flat rope having an entry direction with respect to the sheave and an exit direction with respect to the sheave; and a first positioning device for adjusting a position of the shaft with respect to the entry direction of the flat rope, whereby an axial direction of the shaft is adjusted to be substantially orthogonal to the entry direction.

DETAILED DESCRIPTION OF THE PREFERRED EMBODIMENT

Figure 1:
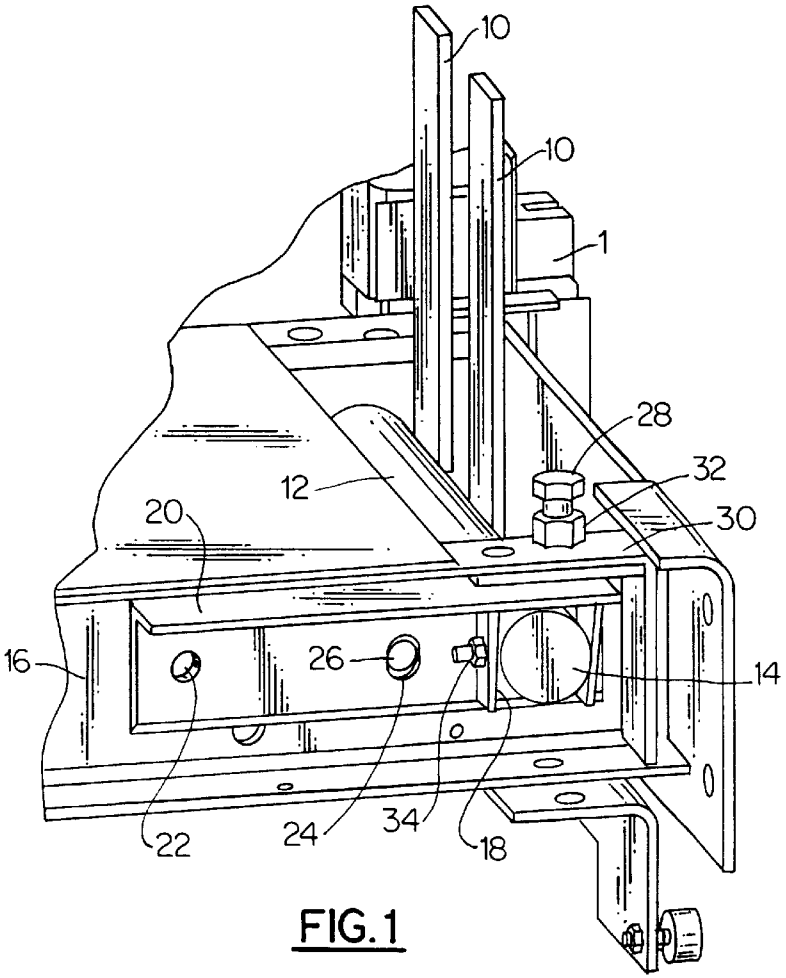
FIG. 1 shows a first embodiment of the present invention.

Referring to FIG. 1, a plurality of CSB's (coated steel belts) 10 are reeved around a shaft 12, or around a sheave (not shown) on shaft 12. Either the sheave is conventionally supported on bearings on shaft 12, or shaft 12 is conventionally supported via bearings in at least one non-rotating end cap 14. Other means of support are known in the art. The direction of the force imposed on shaft 12 depends on the directions that CSB 10 runs with respect to shaft 12. In the simplest case, the entering and leaving directions of CSB 10 are parallel and opposite to the force of gravity, i.e., the force is vertical. In other cases, CSB 10 has an entering direction and a leaving direction angled with respect to the force of gravity. Whatever the direction of the forces imposed on shaft 12 by CSB 10, the steering angle of shaft 12 needs to be adjustable.

In general, there are two cases for adjusting the steering angle of shaft 12. Either the adjustment support is on the same side of shaft 12 as the entering or leaving direction of CSB 10 or on the opposite side. When the adjustment support is on the same side of shaft 12 as the entering or leaving direction of CSB 10, shims or a jack bolt can be used. When the adjustment support is on the opposite side of shaft 12 as the entering or leaving direction of CSB 10, a through-bolt, U-bolt, or any structure that goes around shaft 12 and secures to a permanent support can be used. The following embodiments are therefore examples of these two cases.

End cap 14 fits through a hole (not shown) in a shaft mounting member 16 and through a hole 18 in a lever 20. A first bolt 22 connecting lever 20 and shaft mounting member 16 provides a pivot point for lever 20. A second bolt 26 connects lever 20 and shaft mounting member 16 via a slot 24. A jack bolt 28 threads into a flange 30 off shaft mounting member 16, with an end of jack bolt 28 pushing against lever 20. Flange 30 is optionally integral with shaft mounting member 16. Jack bolt 28 is preferably locked with a jam nut 32. Lever 20 provides several specific advantages.

(a) It reduces friction during the adjustment where the belt wrap of CSB 10 is not 180 degrees.

(b) It provides mechanical advantage of force or displacement to permit fine tuning.

(c) It provides protection to the shaft end once in place since jack bolt 28 acts on lever 20 instead of shaft 12.

(d) It provides flexibility in positioning jack bolt 28 with respect to shaft 12, since one can put jack bolt 28 against shaft 12, or move it closer to the pivot point, or make lever 20 longer and place jack bolt 28 further from the pivot point, which increases the leverage and allows for more fine tuning of the placement of shaft 12.

(e) It permits adjustment when jack bolt 28 cannot act directly on shaft 12 since jack bolt 28 can operate directly on lever 20 instead.

To adjust the orientation of shaft 12, jack bolt 28 is turned, thereby changing the vertical orientation of shaft 12. Once the proper orientation is achieved, shaft 12 is secured by tightening bolts 22 and 26 and locked by jam nut 32. An optional bolt 34 is used to secure shaft 12 against thrust loads. Instead of end cap 14, bearings (not shown) could be mounted in hole 18 of lever 20 for shaft 12. If adjustment is required in two directions, the adjustment apparatus for each direction can be located at the same end of shaft 12 or at opposite ends of shaft 12.

Figure 2:
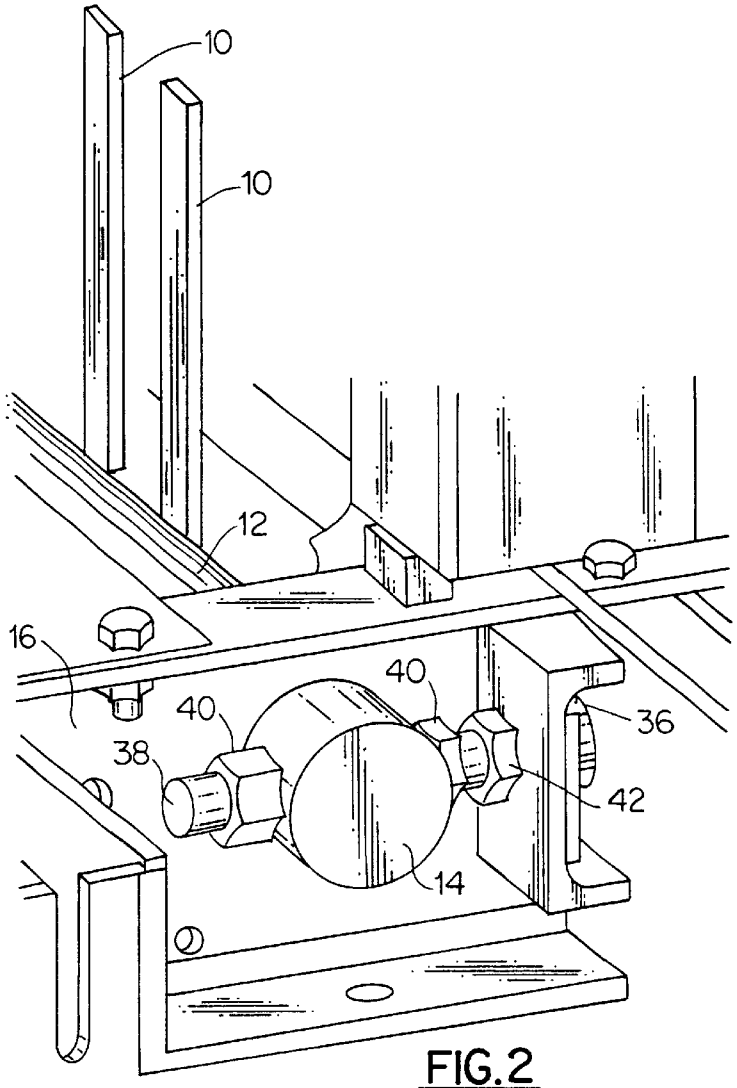
FIG. 2 shows a second embodiment of the present invention.

Referring to FIG. 2, a bracket 36 is attached to shaft mounting member 16. A bolt 38 passes through bracket 36 and end cap 14. Two nuts 40, one on each side of end cap 14, are rotated to adjust the position of shaft 12. Once properly positioned, a jam nut 42 secures shaft 12 with respect to bracket 36.

Figure 3:
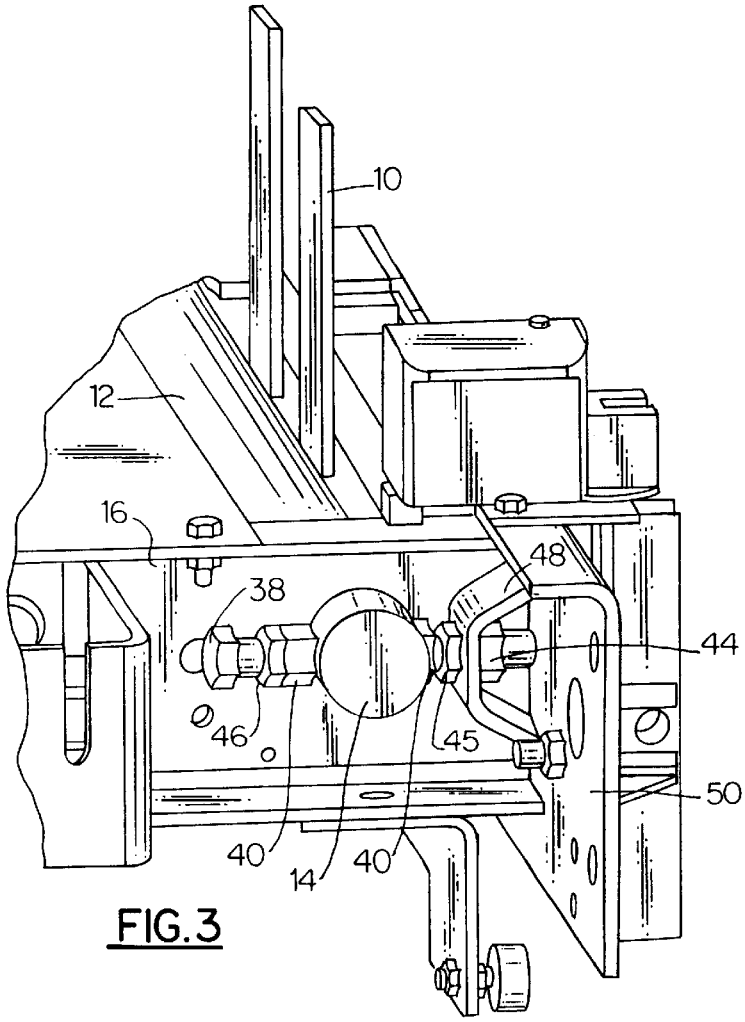
FIG. 3 shows a modification of the second embodiment of the invention.

Referring to FIG. 3, a bracket 48 is attached to a flange 50 of shaft mounting member 16. Bolt 38 can thus be assembled through end cap 14 and then through bracket 48, unlike the embodiment of FIG. 2 where bolt 38 is assembled through bracket 36 and then through end cap 14. Bolt 38 is secured to bracket 48 by nuts 44, 45. Nuts 40 are rotated to adjust the precise position of shaft 12, after which shaft 12 is secured in place by a jam nut 46.

Figure 4:
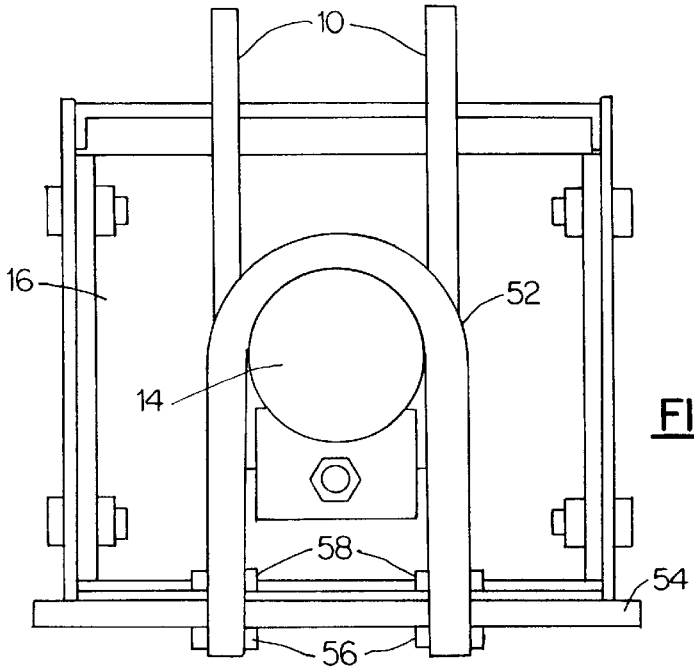
FIG. 4 shows a third embodiment of the present invention.

Referring to FIG. 4, end cap 14 is held in place by a U-bolt 52. An optional groove (not shown) can be cut in end cap 14 to fit U-bolt 52. U-bolt 52 fits through a plate 54 which is attached to shaft mounting member 16, where it is adjusted by a plurality of nuts 56 and secured in the loaded direction by a plurality of nuts 58.

Figure 5:
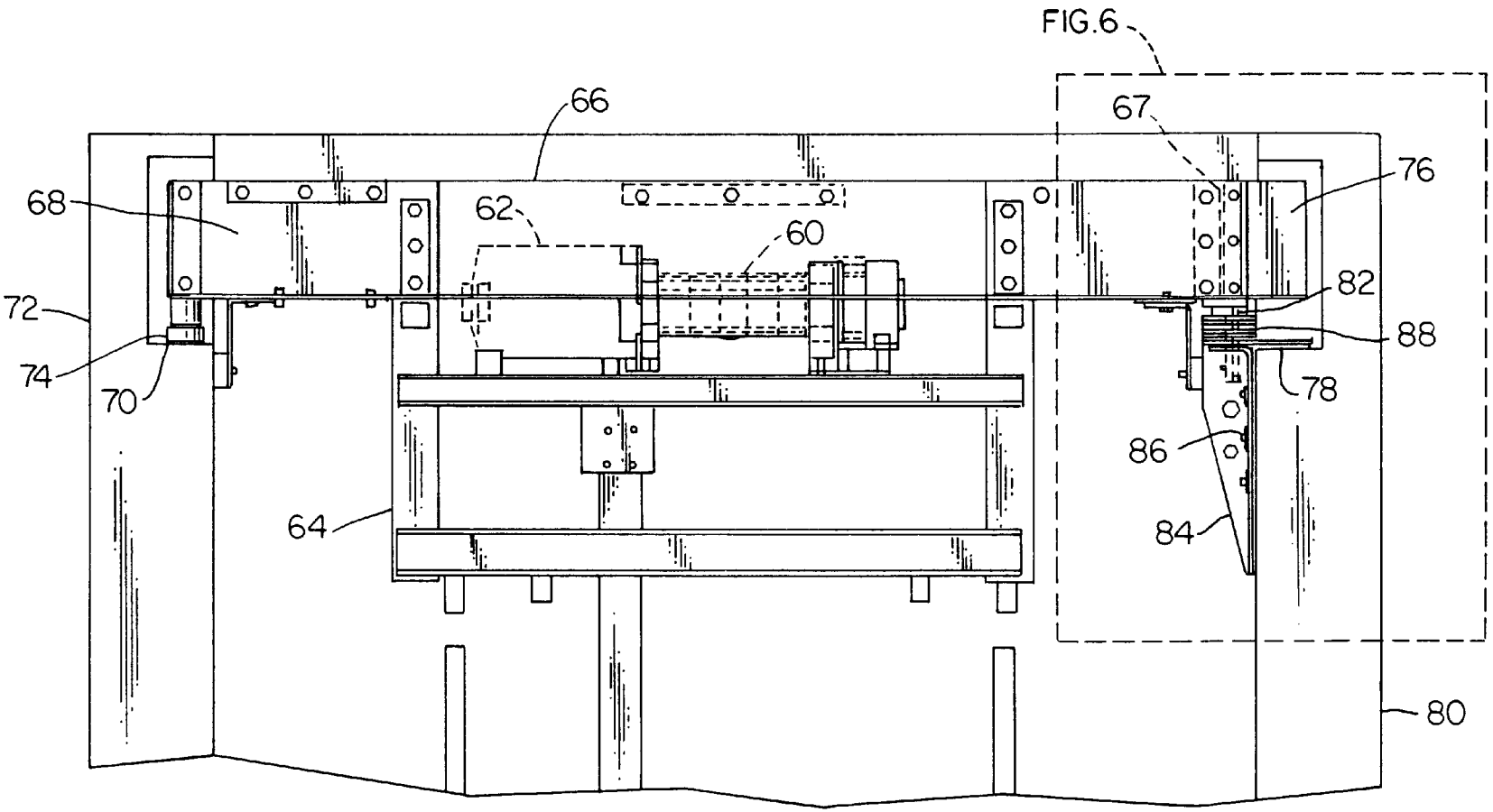
FIG. 5 shows a fourth embodiment of the present invention.

Referring to FIG. 5, at least one coated steel belt (not shown) reeves around a corresponding drive sheave 60. Drive sheave 60 is part of a machine 62, which is known to those skilled in the art as the motor and sheave assembly for an elevator. Machine 62 is mounted in a machine frame 64, which in turn is supported within the elevator hoistway by at least one long beam 66 as shown in FIG. 5. Additional support members, such as support member 67 shown in shadow, are optionally fastened between long beams 66. One end 68 of long beam 66 sits in a pocket 70 of rear hoistway wall 72 on a sound isolation pad 74, while another end 76 of long beam 66 sits in a pocket 78 of front hoistway wall 80 and a sound isolation pad 82.

Figure 6:
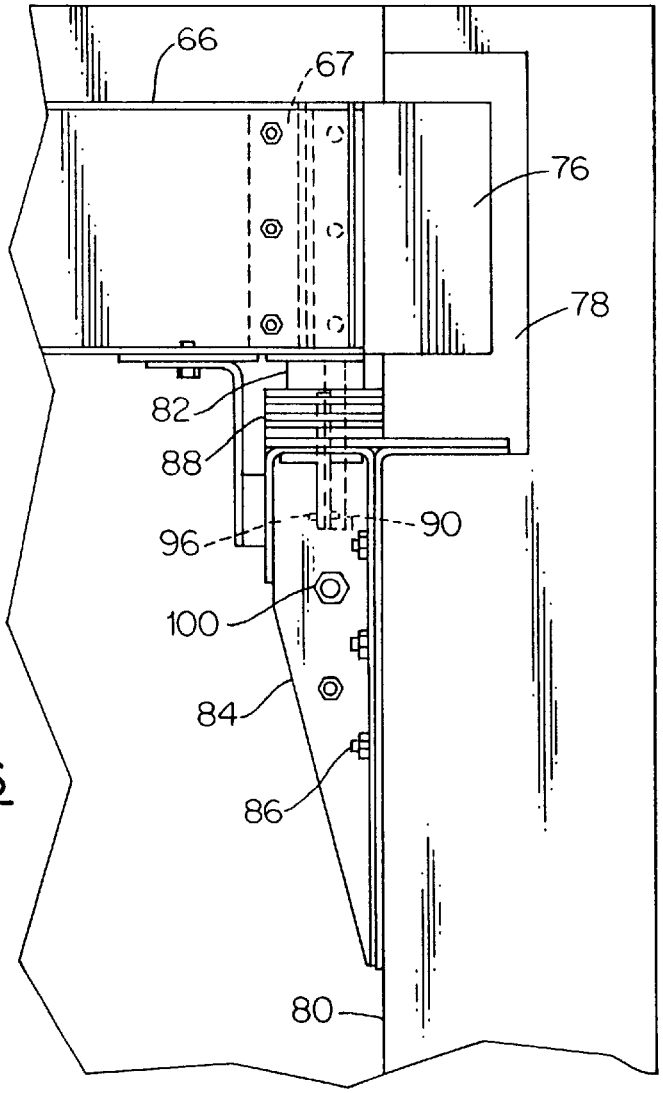
FIG. 6 shows a side view of a tee bracket and associated shims according to the fourth embodiment of the present invention.

Referring also to FIG. 6, a tee bracket 84 sits in pocket 78. Tee bracket 84 is anchored to front hoistway wall 80 by conventional means such as bolts 86. A plurality of shims 88 are on top of tee bracket 84 and under sound isolation pad 82. The system must be designed with a predetermined total shim height, thus allowing the system to be adjusted in both directions by removing or adding shims. When precisely positioning long beams 66, shims 88 are removed or added as necessary. Shims 88 can be all the same thickness or of varying thicknesses preferably ranging from 1 mm to 8 mm thick. The range of the shim stack is preferably from no shims to 100 mm high.

Figure 7:
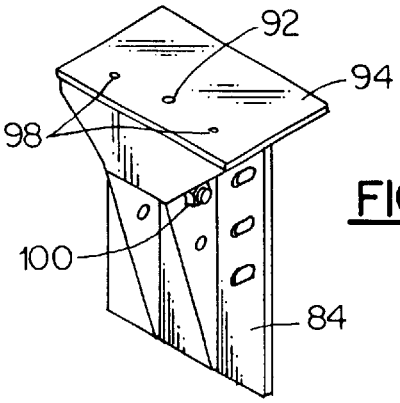
FIG. 7 shows a top view of the tee bracket used in the fourth embodiment of the present invention.

Referring also to FIG. 7, a jack bolt 90 is threaded through a hole 92 in a top 94 of tee bracket 84. Jack bolt 90 preferably abuts against support member, and turning jack bolt 90 raises end 76 of long beam 66 permitting a worker to insert or remove shims 88 as necessary. Horizontal positioning is accomplished by properly emplacing tee bracket 84, while vertical positioning is accomplished via jack bolt 90 and shims 88. Shims are preferably held in place by two shim retaining bolts 96 that are threaded through holes 98 in top 94 of tee bracket 84. Two nuts 100 sized for jack bolt 90 are preferably welded over side holes in tee bracket 84 and are used to store jack bolt 90 after the adjustment of long beams 66 is made.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. Apparatus for adjusting a steering angle of an elevator sheave that is mounted upon a shaft, said apparatus including:

means for retaining said shaft so that the shaft can be adjustably positioned in a first plane and in a second plane;

a flat rope that is engaged by said sheave, said flat rope having a desired entry direction and a desired exit direction with respect to said sheave;

a first positioning means for adjusting the position of said shaft in said first plane; and a second positioning means for adjusting the position of the said shaft in said second plane, whereby the flat rope is maintained in proper alignment as it passes over the sheave.

2. The apparatus of claim 1 that further includes a frame that is connected to said means for retaining said shaft, said frame being mounted in a predetermined position within an elevator hoistway.

3. The apparatus of claim 2 wherein said means for retaining said shaft includes at least one long beam that is connected to said frame;

said first positioning means includes a tee bracket said tee bracket being adjustable mounted upon a wall of said hoistway for positioning the long beam in said first plane; and said second positioning means includes a jack bolt connected to the tee bracket for positioning said beam in said second plane.

4. The apparatus of claim 3 wherein said second positioning means includes shim means that is insertable between the tee bracket and said long beam.

5. The apparatus of claim 4 wherein said shim means further includes an isolation pad.

6. The apparatus of claim 4 that further includes at least one shim retaining bolt for retaining a plurality of shims in assembly.

7. The apparatus of claim 3 wherein said tee bracket further includes storage means for storing a jack bolt.

8. The apparatus of claim 3 wherein a portion of said tee bracket is located within a pocket in said hoistway wall.

9. The apparatus of claim 1 said first plane is substantially parallel to said second plane.

10. The apparatus of claim 1 wherein said first and second positioning means are located at one end of said beam.

* * * * *